United States Patent [19]

Milo

[11] Patent Number: 4,490,996

[45] Date of Patent: Jan. 1, 1985

[54] FILL PIPE LOCK ASSEMBLY

[76] Inventor: August Milo, 478 Schiller St., Elizabeth, N.J. 07206

[21] Appl. No.: 305,113

[22] Filed: Sep. 24, 1981

[51] Int. Cl.[3] ..... B65D 55/14

[52] U.S. Cl. ..... 70/165; 70/231

[58] Field of Search ..... 70/158, 159, 160, 161, 70/162, 163, 164, 165, 166, 167, 168, 169, 170, 171, 172, 173, 229, 231, 232; 220/210

[56] References Cited

U.S. PATENT DOCUMENTS

| | | | |
|---|---|---|---|
| 994,676 | 6/1911 | Henion . | |
| 1,651,168 | 11/1927 | Vickerman . | |
| 1,762,524 | 6/1930 | Pfahl . | |
| 1,961,106 | 5/1934 | Hurd | 70/231 |
| 1,978,314 | 10/1934 | Lancaster . | |
| 2,018,534 | 10/1935 | Rike . | |
| 2,264,760 | 12/1941 | Kling . | |
| 2,287,750 | 6/1942 | Clayton . | |
| 2,684,779 | 7/1954 | Rafferty . | |
| 4,030,628 | 6/1977 | Hippert | 70/159 |

FOREIGN PATENT DOCUMENTS

| | | | |
|---|---|---|---|
| 2929685 | 2/1981 | Fed. Rep. of Germany | 220/210 |

*Primary Examiner*—Robert L. Wolfe

*Attorney, Agent, or Firm*—Steele, Gould & Fried

[57] ABSTRACT

A fill pipe lock assembly for protecting the fill pipe cap of an underground flammable liquid storage tank is disclosed. The lock assembly includes a floating baseplate inserted over the top of the fill pipe and below the adaptor ring and a removable cover. The baseplate is in loose engagement about the fill pipe in a manner which permits the baseplate to be rotated freely about the fill pipe. The baseplate and cover include a pair of cooperating, diametrically opposed, hasps and openings to removably lock the cover to the floating baseplate.

10 Claims, 6 Drawing Figures

FIG. 1
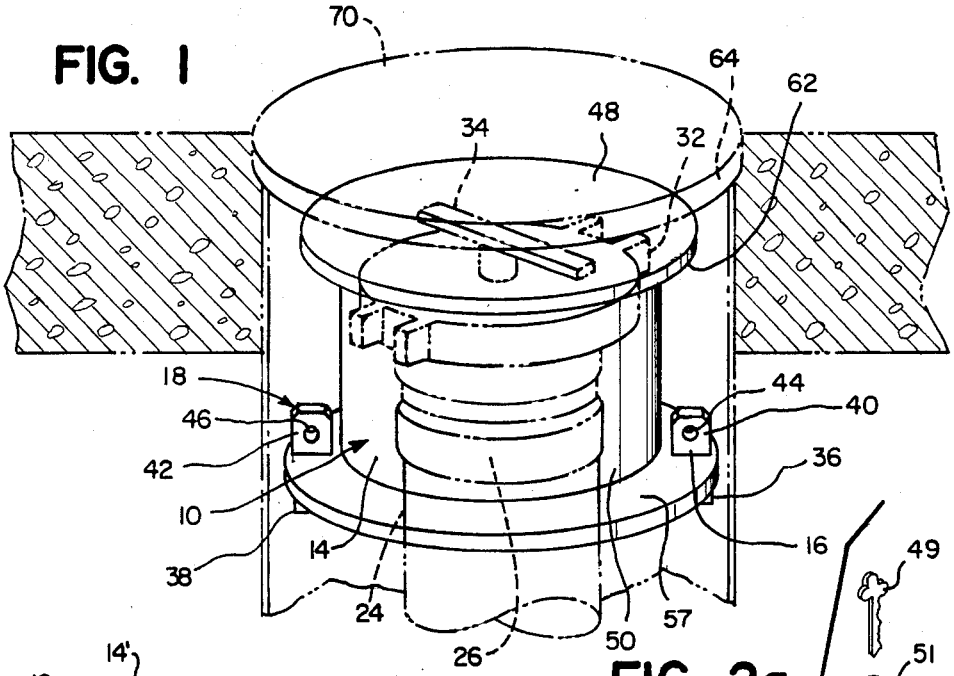
FIG. 2a
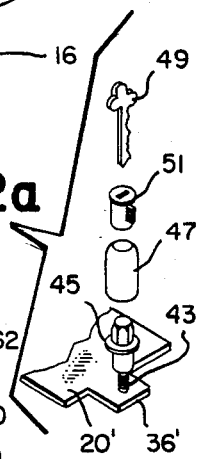
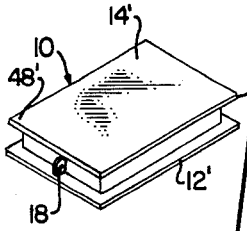
FIG. 1a
FIG. 2
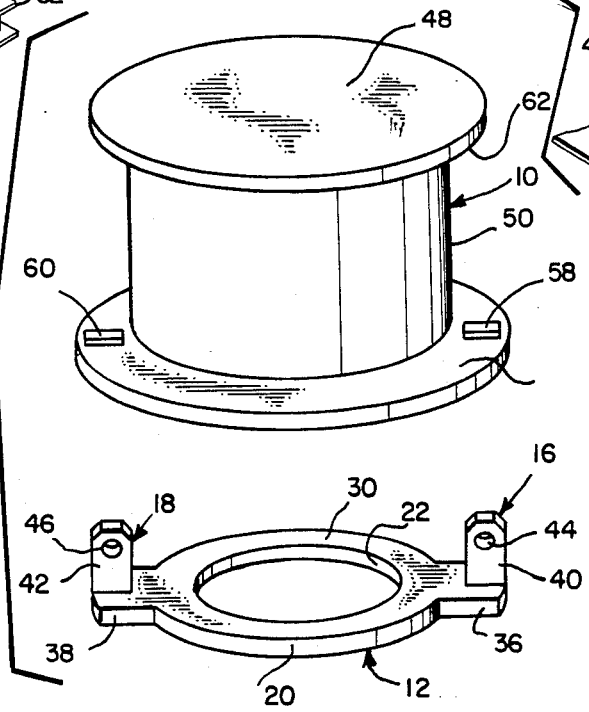

FILL PIPE LOCK ASSEMBLY

BACKGROUND OF THE INVENTION

The present invention relates generally to the field of locking devices for underground tank fill pipes, and more particularly, is directed to a theft deterrent type of locking assembly.

It is the usual practice to store flammable liquids in underground storage tanks to provide adequate safety by minimizing the possibility of fire or explosion. In the usual gasoline service station designed for retail sale, it is the present practice to store flammable liquids such as gasoline in relatively large underground storage tanks, for example tanks of three thousand gallons to ten thousand gallons capacity or more. Most gasoline service stations dispense three or more grades or products and accordingly, multiple banks of such underground storage tanks are in common use throughout the country. Fill pipes with caps or closures lead from ground level to the underground tanks to permit easy filling of the tanks in well known manner and these fill pipes are generally easily accessible to both authorized and unauthorized personnel. Considering the price of gasoline and the number of gallons of such product which may be stored at any given location, it will be appreciated that the underground storage capacity represents a considerable investment by the service station owner. Because of the value of the underground stored product, and the generally exposed and accessible location of the service station, protective steps have to be taken to prevent or discourage theft of gasoline during the evening or other periods when most stations are closed and unattended.

In efforts to correct the problem, prior workers in the art have designed and employed locking type caps for installation over the ends of the fill pipes to prevent easy tampering with the apparatus and to discourage unauthorized removal of the stored tank contents. While the locking type fill caps have proved to be generally satisfactory, it has been found that such devices as are currently available are prone to tampering and destruction by determined thieves because of the fact that most service stations close at night and the would-be thieves have adequate time in which to destroy the locks to thereby gain entrance to the underground stored materials.

While of course almost any type of lock can be broken if the thief possesses sufficient skill, tools, determination and time within which to do the job, the need remains to provide a simply designed, relatively inexpensive tank fill locking system which can offer maximum protection against the efforts of an average gasoline thief.

SUMMARY OF THE INVENTION

The present invention relates generally to the field of underground tank fill pipe locks, and more particularly is directed to a floating locking assembly offering maximum protection against forcible entry.

The present invention includes a baseplate having a hole therethrough of sufficient size to fit over and to receive therethrough the upper portion of an underground tank fill pipe. After the fill pipe is inserted through the baseplate opening, a usual adaptor can be screwed or otherwise affixed to the top of the fill pipe in known manner to thereby lock the baseplate to the fill pipe below the adaptor. It is noteworthy that the connection at the baseplate opening is loose so that the baseplate remains unattached, either to the fill pipe or to the adaptor, thereby allowing the baseplate to rotate or move relative to the fill pipe. In this manner, the free floating nature of the baseplate relative to the fill pipe functions to foil efforts on the part of a would-be thief to unscrew or otherwise remove either the baseplate or the adaptor from association with the fill pipe.

In the preferred embodiment, the baseplate is provided with a pair of diametrically opposed hasps which are welded or otherwise formed to become an integral part of the baseplate. A cover overfits the baseplate and includes a depending, cylindrical or other shaped skirt which extends in length a distance suitable to encompass both the adaptor and the fill pipe cap in a protective manner to shield the cap and the adaptor from unauthorized tampering. The skirt is provided with integral, diametrically opposed ears having openings of suitable configuration to fit down over the hasps and to receive the hasps therethrough. A pair of locks can then be applied through the hasps in usual manner to removably secure the cover to the baseplate. The combination of the apertured baseplate and the locked cover forms a theft deterrent box in protective, shielding arrangement over and about the top of the fill pipe.

Because the deterrent proof box of the present invention floats and is free to rotate about the fill pipe when it is mdunted and locked in place, any effort to chisel or force the hasps will be made more difficult since there is nothing firm to strike against and the unit will swing away or give way when every blow is struck. Because of the floating nature of the mounting of the theft proof box, there will be no firm structure to absorb the force of blows from a hammer or the leverage action of a crow bar. Therefore, a would-be thief will find it most difficult to chisel or break the hasps when employing the usual type of burglary tools. The construction parts of the present invention may be hardened to provide a sturdy, simply constructed, tank fill protection device in a manner to offer greater resistance to theft.

It is therefore an object of the present invention to provide an improved fill pipe lock assembly of the type set forth.

It is another object of the present invention to provide a novel fill pipe lock assembly that incorporates a floating, lockable cover for protection of underground fill pipes.

It is another object of the present invention to provide a novel fill pipe lock assembly comprising generally a baseplate having an opening therein to receive the upper end of an underground fill pipe therethrough in a loose engagement, an adaptor ring threadedly engaged upon the upper end of the fill pipe to secure the fill pipe and the baseplate, and a cover overfitting the fill pipe adaptor and arranged to cover the fill pipe opening, the cover being lockable to the baseplate to provide a loose fitting, movable locking cover over the fill pipe.

It is another object of the present invention to provide a novel fill pipe lock assembly including floating means to movably engage the upper end of an underground tank fill pipe, securing means to secure the floating means near the top of the fill pipe, cover means overfitting the floating means and covering the securing means and locking means to lockably engage the cover means to the floating means.

It is another object of the present invention to provide a novel fill pipe lock assembly that is simple in design, rugged in construction and trouble free when in use.

Other objects and a fuller understanding of the invention will be had by referring to the following description and claims of a preferred embodiment thereof, taken in conjunction with the accompanying drawings, wherein like reference characters refer to similiar parts throughout the several views and in which:

BRIEF DESCRIPTION OF THE DRAWINGS

FIG. 1 is a perspective view showing the fill pipe lock assembly applied in locking arrangement over the upper terminus of an underground tank fill pipe, the existing fill pipe construction being indicated in phantom lines for purposes of association.

FIG. 1*a* is a perspective view similar to FIG. 1, on reduced scale, illustrating a lock assembly construction of different configuration.

FIG. 2 is an enlarged, exploded perspective view of the lock assembly.

FIG. 2*a* is an exploded, enlarged, perspective view of a modified cover locking system.

DESCRIPTION OF THE PREFERRED EMBODIMENT OF THE INVENTION

Figure 3:
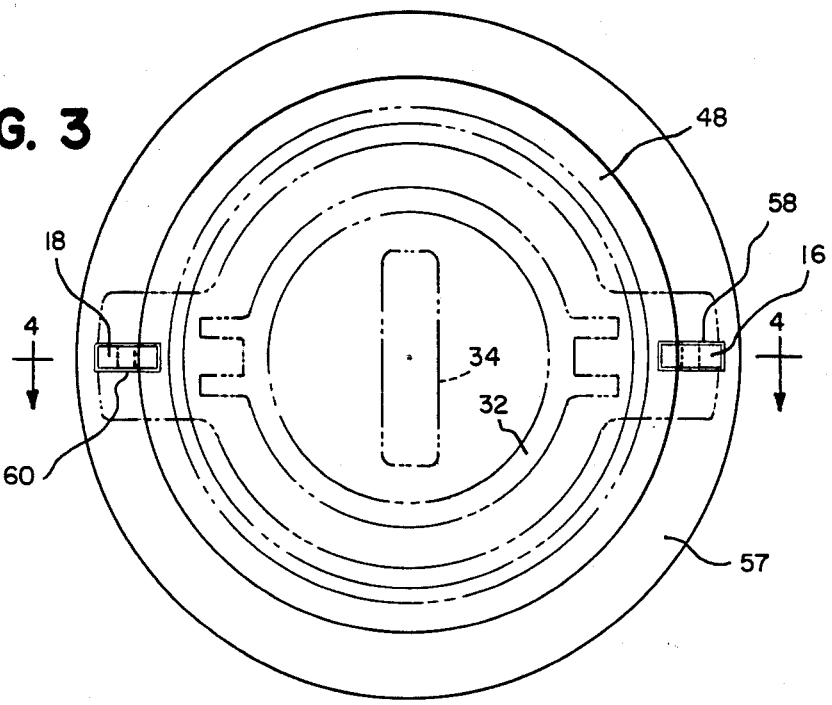
FIG. 3 is a top plan view showing the lock assembly in locking arrangement.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIGS. 1, 1*a* and 2 a fill pipe lock assembly generally designated 10, 10' which comprises a floating baseplate means 12, 12' a removable cover means 14, 14' and lock means 16, 18 to releasably secure the cover means to the floating baseplate means 12.

In the embodiment of FIGS. 1 and 2, the baseplate means 12 comprises generally a base 20 having an opening or hole 22 provided therein in usual manner during the manufacturing process, for example, by casting. The hole 22 is sized to receive therethrough the upper end of a conventional underground fill pipe 24 which is usually of four inch diameter or three inch diameter. After the baseplate means is applied over the top of the fill pipe 24, the usual fill pipe adaptor 26, of design well known to those skilled in the art, is threadedly or otherwise engaged over the top of the fill pipe 24. The diameter of the hole 22 is formed sufficiently large to overfit the outer diameter of the fill pipe 24 without frictional engagement thereupon and sufficiently small to be less than the outer diameter 28 of the adaptor 26.

Accordingly, once the adaptor is threadedly engaged over the top of the fill pipe 24 and over the top 30 of the base 20, the baseplate means 12 cannot be upwardly removed from the top of the fill pipe 24 without first disengaging the adaptor 26. As illustrated, a conventional cap 32 is applied over the adaptor 26 to conventionally close the top of the fill pipe 24. The cap 32 preferably includes other integral, known construction to facilitate easy threaded engagement and disengagement of the cap 32 to the adaptor 26.

The base 20 terminates outwardly in a pair of diametrically opposed or otherwise positioned extension arms 36, 38 to which are affixed in sturdy, integral manner respective vertically positioned locking devices or hasps 40, 42. Each hasp 40, 42 includes a lock receiving opening 44, 46 therein for locking the device, as hereinafter more fully set forth. Alternately, the locking devices or hasps could be provided in the cover flange 57 and could project downwardly. In such a construction, the cooperating elongated openings would then be provided in the extension arms of the base 20 in registry below the hasps.

The cover means 14 comprises generally a circular or other shaped solid cover 48 and an integral, cylindrical, or other shaped depending skirt 50. The skirt sidewalls extend in length or depth a distance sufficient to readily accommodate the height of the adaptor 26, the tank fill cap 32 and a handle 34, if one exists. If desired, the underside 52 of the cover 48 may rest directly upon the top of the handle 34 after final installation. The sidewalls 50 terminate downwardly in a circular flange 57 (FIG. 2) or respective, diametrically opposed ears 54, 56 (FIG. 4) which ears are spaced apart and positioned as necessary to register over the hasps 40, 42. As illustrated in FIGS. 1 and 2, the flange 57 is provided with respective elongated openings 58, 60 of size and position to readily receive the respective hasps 40, 42 therethrough when the cover means 14 is positioned over the floating baseplate means 12.

In the modified locking construction of FIG. 2*a*, the extension arms 36' of the modified base 20' could be equipped with lugs 43 suitable for receipt thereon of a locking device 45, 47 of known construction, for example, a commonly employed auto wheel locking device. In this construction, a key 49 would be utilized in the usual manner to function the lock cylinder 51.

Figure 4:
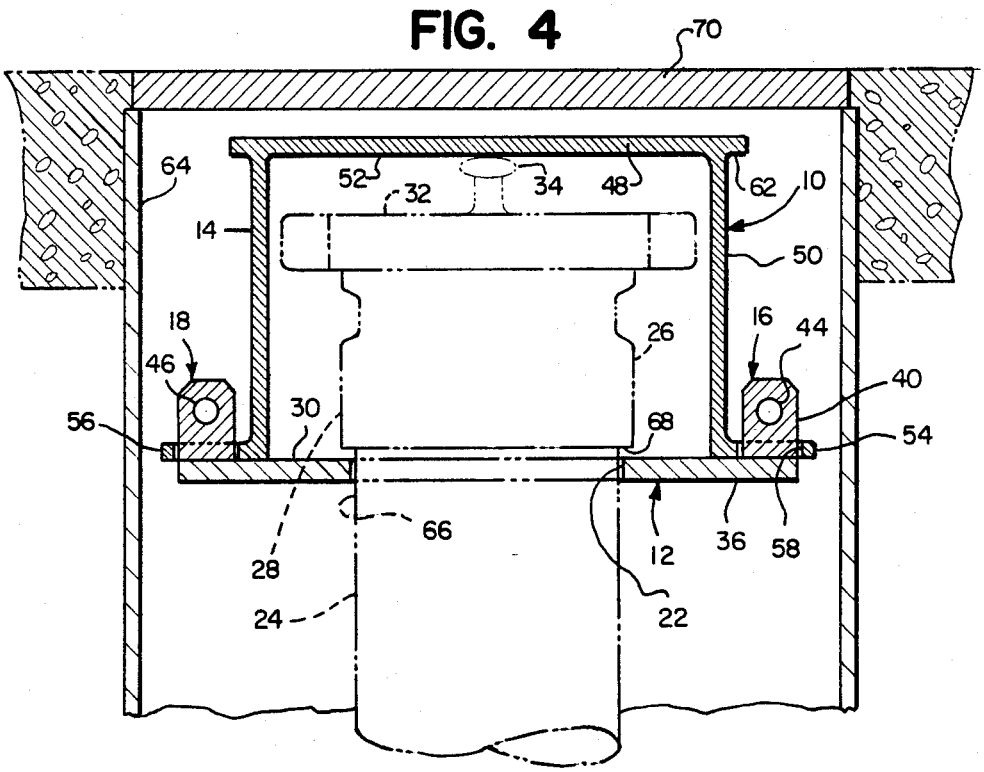
FIG. 4 is a cross sectional view taken along line 4—4 on FIG. 3, looking in the direction of the arrows.

When the cover means 14, 14' is installed over the baseplate means 12, 12' as illustrated in FIGS. 1*a*, 3 and 4, the parts may be locked in position over and about the adaptor 26 and fill cap 32 by employing a pair of conventional locks (not shown) which can be inserted through the hasp openings 44, 46 in well known, lockable and releaseable manner. If desired, the cover 48, 48' can be provided with an annular or other shaped flange 62, 62' to provide additional protection to the locks (not shown), depending upon the size and shape of the conventional manhole 64 within which the fill pipe lock assembly 10 is employed. Under the circumstances, a large manhole 64 might require a larger annular or other shaped flange 62, 62' than a narrow manhole to thereby limit the accessability to the locks for protection purposes.

In order to use the fill pipe lock assembly of the present invention, the cover 70, 70' of the existing manhole 64, 64' is removed to expose the top 66 of the fill pipe 24 at the usual fill pipe cap 32. The fill pipe cap 32 and the conventional adaptor 26 are then removed, thereby clearing the top 66 of the fill pipe 24 of any obstructions. With the unobstructed top 66 of the fill pipe thus exposed, the floating baseplate means 12 is positioned over the fill pipe with the base opening 22 registered over the top of the fill pipe 24. The floating baseplate means 12 is then downwardly urged within the manhole 64 until the base 20 rests upon the manhole bottom construction with the fill pipe top 66 projecting upwardly through the hole 22. In this position, the adaptor 26 is then reinstalled by threading or otherwise to the top 66 of the fill pipe 24 with the outer diameter 28 of the adaptor 26 defining an extending, circular shoulder 68. The shoulder 68 functions to prohibit any outward or upward movement of the floating baseplate 12 relative to the top of the fill pipe 24. The cap 32 can then be reinstalled in the adaptor 26 in the usual manner to close the fill pipe.

With the floating baseplate means 12 thus movably secured in position, the cover means 14 is then positioned over the baseplate means 12 with the locking openings 58, 60 positioned over the vertically oriented hasps 40, 42. The cover means 14 is then allowed to rest directly upon the top 30 of the base 20, thereby completely enclosing the top of the fill pipe 24, the adaptor 26 and the cap 32. Suitable padlocks (not illustrated) can then be inserted through the hasp openings 44, 46 to prevent unwanted upward movement of the cover means 14 relative to the floating baseplate means 12. Should a would-be thief attempt to force the locks (not shown) or to damage the hasps 40, 42 by striking direct blows, the floating arrangement of the baseplate means 12 about the fill pipe 24 which is provided by the loose fit between the outer diameter of the fill pipe and the boundaries of the hole 22 will allow the entire lock assembly 12, 14 to rotate about the stationary fill pipe 24. Thus, much of the energy of any blow will be absorbed by the movement of the lock assembly 10 so that the full force of the blow cannot be brought directly upon any of the parts.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A fill pipe lock assembly for protecting the top of a fill pipe of the type having an adaptor fitting, comprising floating baseplate means to loosely overfit the fill pipe below the adaptor, the floating baseplate means being provided with an opening of diameter larger than the diameter of the fill pipe and smaller than the diameter of the adaptor, the floating baseplate means comprising a pair of diametrically opposed hasps, cover means in registry over the floating baseplate means and covering the top of the fill pipe, the cover means comprising an integral cover, sidewalls and base locking means to secure the cover to the floating baseplate means, the hasps being releaseably engaged with the said base locking means to prevent unwanted removal of the cover means, the base locking means comprising a pair of diametrically opposed openings, the hasps being insertable upwardly through the openings to receive locks thereon to prevent unauthorized removal of the cover means.

2. The fill pipe lock assembly of claim 1 wherein the base locking means comprises a circular flange provided with a pair of openings therein, the openings being positioned to respectively receive the hasps therethrough.

3. The fill pipe lock assembly of claim 1 wherein the cover of the cover means comprises an annular flange, the annular flange extending peripherally outwardly from the said sidewalls.

4. The fill pipe lock assembly of claim 3 and a pair of locks securing the hasps to the base locking means.

5. The fill pipe lock assembly of claim 4 wherein the said annular flange overlies at least part of each lock.

6. A fill pipe lock assembly for covering the upper end of a fill pipe having an outer diameter comprising a baseplate loosely overfitting the upper end of the fill pipe, the baseplate having an opening of sufficient diameter through which the upper end of the fill pipe inserts;

an adaptor securely engaged upon the upper end of the fill pipe above the baseplate to secure the baseplate to the fill pipe, the adaptor having an outer diameter that is larger than the outer diameter of the fill pipe;

a cover overfitting the adaptor and arranged to cover the upper end of the fill pipe and at least a part of the baseplate;

means to permit free movement of the baseplate relative to the fill pipe, the means to permit free movement comprising a baseplate opening diameter of greater dimensions than the fill pipe outer diameter; and lock means to releaseably secure the cover to the baseplate, the lock means being adapted to be moved relative to the fill pipe when the baseplate is moved relative to the fill pipe.

7. The fill pipe lock assembly of claim 6 wherein the diameter of the baseplate opening is less than the outer diameter of the adaptor.

8. The fill pipe lock assembly of claim 7 wherein the cover comprises a top circular cover and sidewalls depending therefrom, the cover further comprising an annular flange extending radially outwardly from the sidewalls, a part of the annular flange registering over and covering at least a part of the lock means to inhibit access to the lock means.

9. The method of protecting the fill opening of an underground tank of the type including a fill pipe of a first outer diameter extending from the tank to a grade mounted manhole and having an adaptor secured to the fill pipe at the upper section thereof and a cap accessible within the manhole comprising the steps of removing the adaptor and cap from the fill pipe and exposing the upper fill pipe section;

providing an opening in a baseplate of second diameter slightly greater than the fill pipe first outer diameter and inserting the baseplate over the fill pipe by positioning the fill pipe within the baseplate opening without securing the baseplate to the fill pipe;

securing an adaptor having a third outer diameter that is greater than the said baseplate opening second diameter to the upper fill pipe section over the baseplate and limiting the upward movement of the baseplate relative to the fill pipe;

covering the upper section of the fill pipe and the adaptor with a strong, portable cover in a manner to permit free movement of the cover relative to the fill pipe; and locking the cover to the baseplate without any fixed connection between the cover and the fill pipe.

10. The method of claim 9 and the additional steps of reinstalling the cap in the adaptor and resting the cover upon a portion of the cap after locking the cover to the baseplate.

* * * * *